US006910991B2

(12) United States Patent
Matsumoto

(10) Patent No.: US 6,910,991 B2
(45) Date of Patent: Jun. 28, 2005

(54) STATIONARY BIKE

(75) Inventor: Masaaki Matsumoto, Sakai (JP)

(73) Assignee: Cateye Co., Ltd., Osaka (JP)

( * ) Notice: Subject to any disclaimer, the term of this patent is extended or adjusted under 35 U.S.C. 154(b) by 0 days.

(21) Appl. No.: 10/680,034

(22) Filed: Oct. 7, 2003

(65) Prior Publication Data

US 2005/0064994 A1 Mar. 24, 2005

(30) Foreign Application Priority Data

Sep. 18, 2003 (JP) ..... 2003-326094

(51) Int. Cl.[7] ..... A63B 22/06

(52) U.S. Cl. ..... 482/8; 482/51; 482/57; 482/902; 434/61

(58) Field of Search ..... 482/1–9, 51, 57, 482/61–63, 900–902; 463/37, 38; 434/61

(56) References Cited

U.S. PATENT DOCUMENTS

| | | | | |
|---|---|---|---|---|
| 4,512,567 A | | 4/1985 | Phillips | |
| 4,637,605 A | * | 1/1987 | Ritchie | 463/37 |
| 5,240,417 A | * | 8/1993 | Smithson et al. | 434/61 |
| 5,415,550 A | * | 5/1995 | Aoki et al. | 434/61 |
| 5,785,630 A | | 7/1998 | Bobick et al. | 482/4 |
| 6,561,952 B2 | | 5/2003 | Wu | |
| 2003/0171190 A1 | | 9/2003 | Rice | 482/57 |

FOREIGN PATENT DOCUMENTS

| | | |
|---|---|---|
| EP | 0 392 014 | 10/1990 |
| WO | WO 03/018391 | 3/2003 |

* cited by examiner

*Primary Examiner*—Glenn E. Richman
(74) *Attorney, Agent, or Firm*—Olson & Hierl, Ltd.

(57) ABSTRACT

A stationary bike can control a display content appearing on a screen in accordance with its operation. The stationary bike basically includes a body, a handlebar rotatably attached to the body and a control unit controlling the display content on the screen, and is characterized by a restoring mechanism restoring the handlebar to an initial position. The restoring mechanism is configured with a coil spring wound around an outer circumference of a shaft, a hook securing one end of the coil spring to the shaft, and a hook securing the other end of the coil spring to a tubular member. The hooks are respectively engaged with a bolt secured to the shaft and with a bolt secured to the tubular member.

6 Claims, 7 Drawing Sheets

STATIONARY BIKE

BACKGROUND OF THE INVENTION

1. Field of the Invention

The present invention relates to a stationary bike, and more particularly to a stationary bike controlling a display content appearing on a screen.

2. Description of the Background Art

Conventional stationary bikes are disclosed, for example, in U.S. Pat. No. 4,512,567 and U.S. Pat. No. 6,561,952.

U.S. Pat. No. 4,512,567 discloses an exercise bike having a variable resistor and a generator for outputting an electrical signal indicative of a state of a handlebar or pedal operation, which is reflected in movements in a video game. Here, the handlebar is connected to the variable resistor through a gear or the like.

U.S. Pat. No. 6,561,952 discloses a stationary bike using a monitor display or the like to allow users to feel virtual operations as if they are on a real road. The stationary bike has a mechanism including a shade plate having openings sandwiched between two circuit boards for limiting light to be transmitted and a sensor for detecting the light thereby detecting a rotation angle of a handlebar.

The stationary bikes as mentioned above, however, have the following problems.

The stationary bikes in the conventional examples as described above can detect and output a rotation angle of a handlebar.

The conventional examples, however, do not disclose a restoring mechanism that allows a handlebar to return to the vicinity of an initial position (a forward direction), of itself. Therefore, this stationary bike sometimes involves difficulty in handlebar operations during its operation.

SUMMARY OF THE INVENTION

An object of the present invention is to provide a stationary bike facilitating a handlebar operation.

In accordance with the present invention, a stationary bike controlling a display content appearing on a screen includes: a body; a handlebar rotatably attached to the body, a control unit for controlling the display content appearing on the screen; and a restoring mechanism restoring the handlebar to an initial position.

Therefore, a stationary bike facilitating a handlebar operation can be obtained.

Preferably, the stationary bike described above further includes: a handlebar rotation angle detector detecting a rotation angle of the handlebar; a pedal connected to the body; a speed signal generator generating a speed signal in accordance with the rotation speed of the pedal; and a brake signal generator generating a brake signal. The control unit preferably includes a controller receiving a signal from the handlebar rotation angle detector, the speed signal generator- and the brake signal generator for being reflected in the display content on the screen.

Therefore, the handlebar, pedal and brake operation can be reflected in the display content on the screen, thereby-giving a feel close to a real operation of a bicycle.

Preferably, the stationary bike described above further includes: a rotary shaft rotating in connection with a rotating motion of the handlebar; and a tubular member accommodating the rotary shaft. The restoring mechanism includes a coil spring wound around an outer circumference of the rotary shaft, a first securing portion securing one end of the coil spring to the rotary shaft, and a second securing portion securing the other end of the coil spring to the tubular member.

Therefore, the restoring mechanism in a compact structure can be obtained.

Preferably, an angle between an installation plane where the body is installed on a horizontal plane and a shaft center of the rotary shaft is at least 68° and at most 73°.

This angle allows the user to operate the handlebar most conveniently. This angle employed in the stationary bike described above can facilitate the handlebar operation of the bike.

Preferably, the handlebar rotation angle detector has a driving shaft driven to rotate by the rotary shaft. The rotary shaft has a connecting member having a first groove portion receiving the driving shaft for connecting the rotary shaft to the driving shaft and a pin attached to the rotary shaft and extending in a direction orthogonal to the first groove portion. The connecting member includes a second groove portion receiving the pin in a rotatable manner. A spacer formed of an elastic member is arranged between the connecting member and the driving shaft.

Here, the rotation of the pin means rolling of the pin in the second groove portion.

Therefore, deflection at the tip end of the rotary shaft on the side of the handlebar rotation angle detector during the handlebar operation can be absorbed. As a result, the handlebar rotation angle can readily be detected.

Preferably, the stationary bike described above includes a stopper mechanism for limiting a rotation angle of the handlebar.

Therefore, an adequate handlebar operation can be performed.

As described above, in accordance with the present invention, the handlebar can be operated easily during the operation of the stationary bike.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

In the following, an embodiment of a stationary bike in accordance with the present invention will be described with reference to FIGS. 1 to 11.

A stationary bike in accordance with the embodiment of the present invention is a fixed bike providing a virtual operation of a bicycle with a display content on a screen being controlled. It is noted that the stationary bike is used in a variety of usages such as games, exercise, and the like.

A stationary bike in accordance with the present embodiment includes a body, a handlebar rotatably attached to the body, a control unit for controlling a display content on a screen, and a restoring mechanism restoring the handlebar to an initial position.

Therefore, during the operation of the stationary bike, the user hardly makes a forcedly sharp turn or the user easily returns the handlebar that is turned to the left or right to the vicinity of an initial position (a forward direction). Moreover, even if the user releases the handlebar, the handlebar that is turned to the left or right returns to the vicinity of the initial position, of itself. As a result, the handlebar can easily be operated.

The embodiment of the present invention will now be described in detail with reference to the figures.

Figure 1:
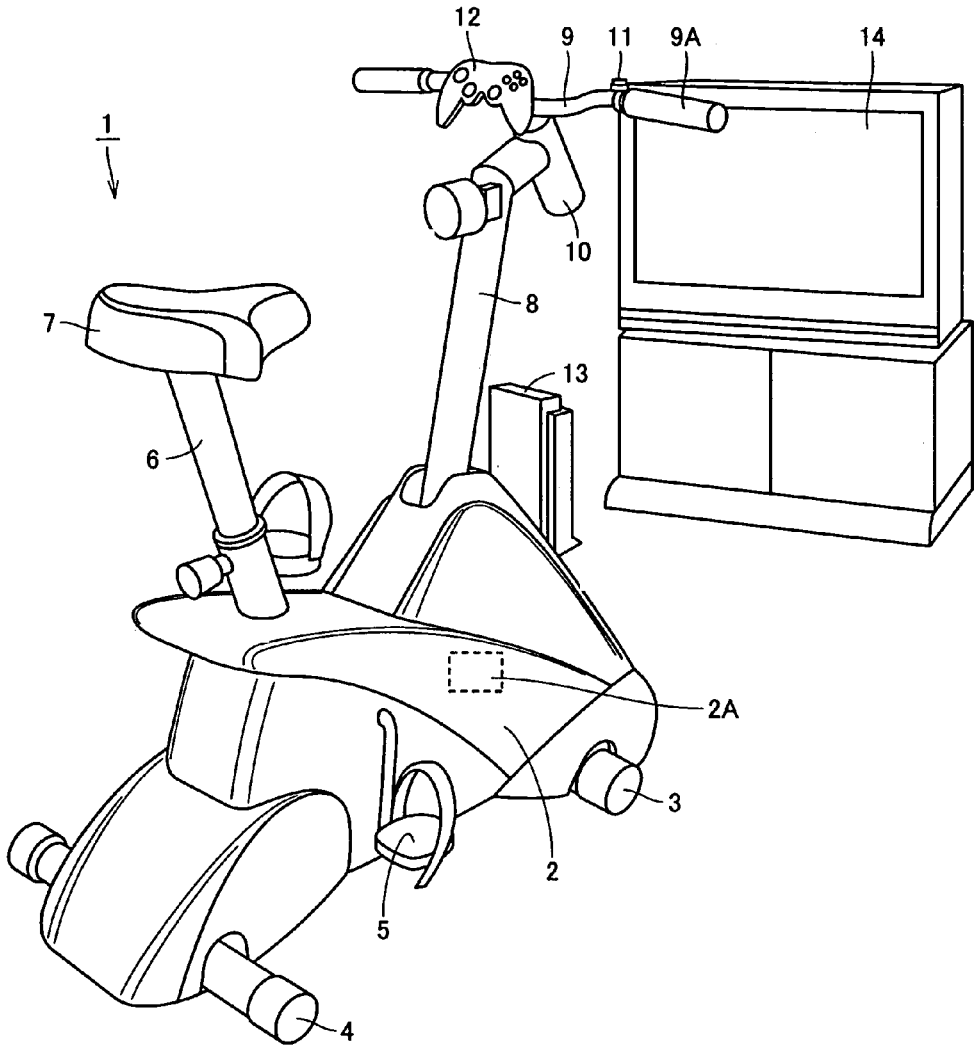
FIG. 1 is a perspective view showing a stationary bike in use in accordance with one aspect of the present invention.

FIG. 1 is a perspective view showing an exemplary use of the stationary bike in accordance with the embodiment of the present invention.

Referring to FIG. 1, a stationary bike 1 includes a body 2, a front leg 3 and a back leg 4 supporting body 2, a pedal 5 attached to body 2, a saddle 7 attached to body 2 through a seat post 6, a handlebar post 8, and a handlebar 9 rotatably attached to body 2 through handlebar post 8 and a tubular member 10.

The tubular member contains a not-shown rotation sensor (a handlebar rotation angle detector) detecting a rotation angle of handlebar 9. This rotation sensor may include, for example, a variable resistor. Body 2 contains speed sensor 2A (a speed signal generator) generating a speed signal in accordance with the rotation speed of the pedal 5. Handlebar 9 is provided with a brake button 11 (a brake signal generator) generating a brake signal. Controller 12 is connected to the rotation sensor, the speed sensor and brake button 11 described above as well as a game machine body 13 through a not-shown connecting line, for receiving a signal from the rotation sensor, speed sensor and brake button 11 and outputting the signal to game machine body 13. The signal transmitted to game machine body 13 is displayed on a monitor 14 (a screen). Therefore, the handlebar operation, pedal operation and brake operation are reflected in the display content on monitor 14, so that the user can enjoy a game using stationary bike 1.

Monitor 14 can display a vision of an operator in an operation of a bicycle, thereby providing a virtual operation with stationary bike 1. In this case, monitor 14 can give a display in such a manner that the bike travels in the direction to which the handlebar is turned, or the landscape flows fast toward the back as if the bike is accelerated by pedaling fast, or as if the bike is decelerated by pushing the brake button.

It is noted that controller 12 is provided with a speed sensitivity adjuster and a handlebar sensitivity adjuster. The monitor display therefore can properly respond to the pedal operation or the handlebar operation.

In this way, the handlebar, pedal and brake operation can be reflected in the display content on the screen, thereby giving a feel close to a real operation of a bicycle.

Game machine body 13 may be a general-purpose game machine that is commonly used. Controller 12 is provided with buttons corresponding to the pedal, brake and handlebar operations. The user can enjoy games and the like only with controller 12, game machine body 13 and monitor 14.

Figure 2:
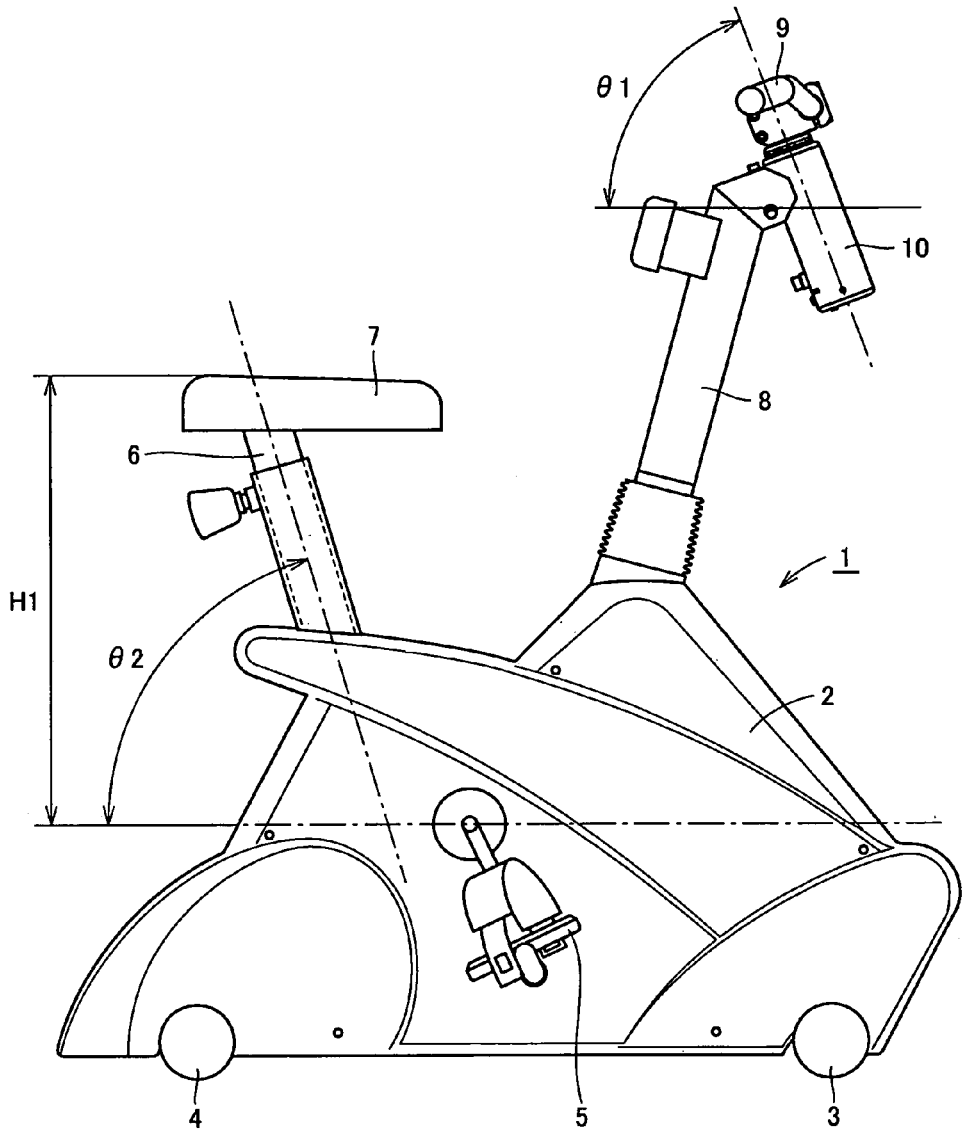
FIG. 2 is a side view showing the stationary bike in accordance with one aspect of the present invention.
Figure 3:
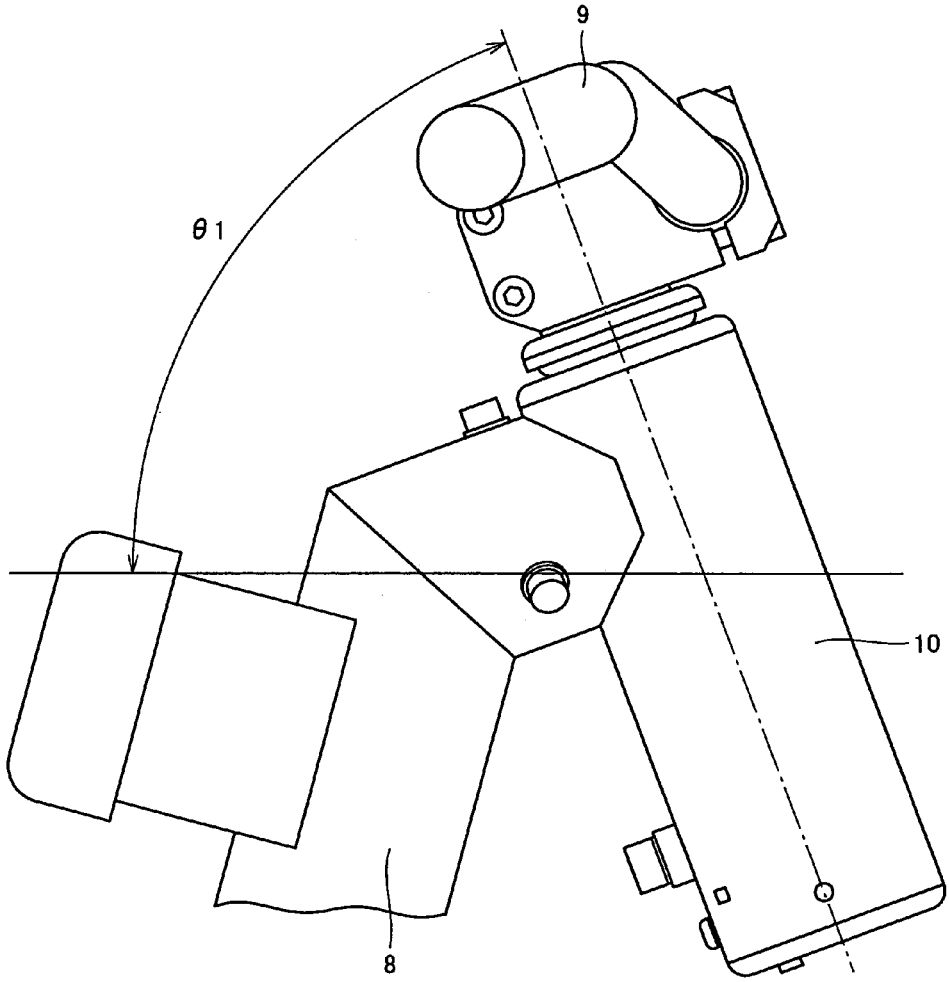
FIG. 3 is an enlarged side view showing a handlebar part in the stationary bike in accordance with one aspect of the present invention.

FIG. 2 is a side view of stationary bike 1, and FIG. 3 is an enlarged view around handlebar 9.

Referring to FIGS. 2 and 3, it is preferable that an angle (θ 1 in FIGS. 2 and 3; a caster angle) between an installation plane where body 2 is installed on the horizontal plane and a shaft center of a shaft (rotary shaft) of handlebar 9 is at least 68° and at most 73°.

In an operation of a two-wheeled vehicle, the caster angle (θ 1) at which the handlebar operation is most convenient is approximately 70°. The caster angle set at the aforementioned range can facilitate the handlebar operation of stationary bike 1.

The angle (θ 2 in FIG. 2) between the installation plane where body 2 is installed on the horizontal plane and the shaft center of seat post 6 is approximately 74°.

Seat post 6 has a variable length, and the height (H1 in FIG. 2) from the center of rotation of pedal 5 to the saddle can be adjusted to suit the figure of the user of stationary bike 1.

Figure 4:
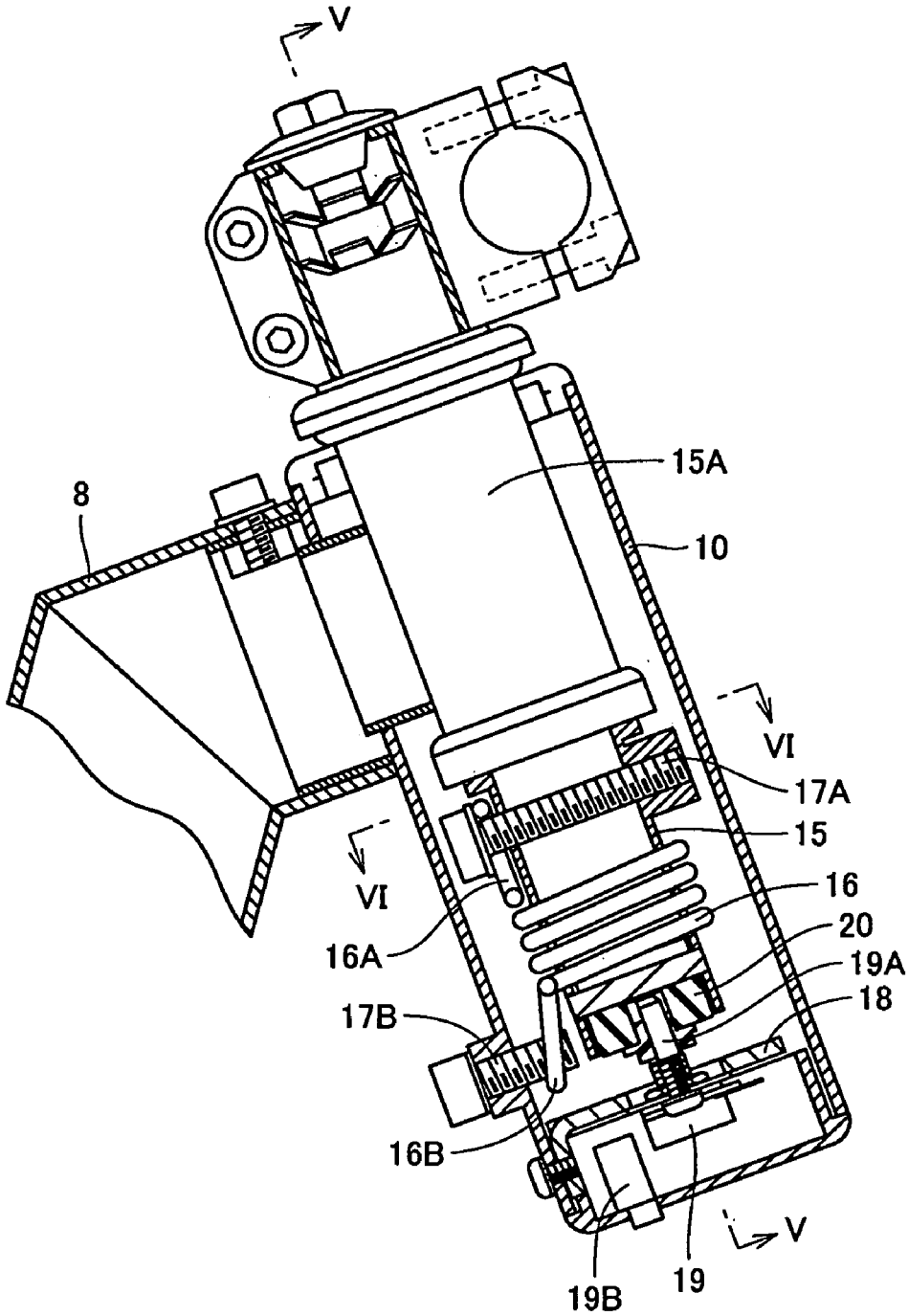
FIG. 4 is an enlarged partial cross-sectional side view showing the handlebar part in the stationary bike in accordance with one aspect of the present invention.
Figure 5:
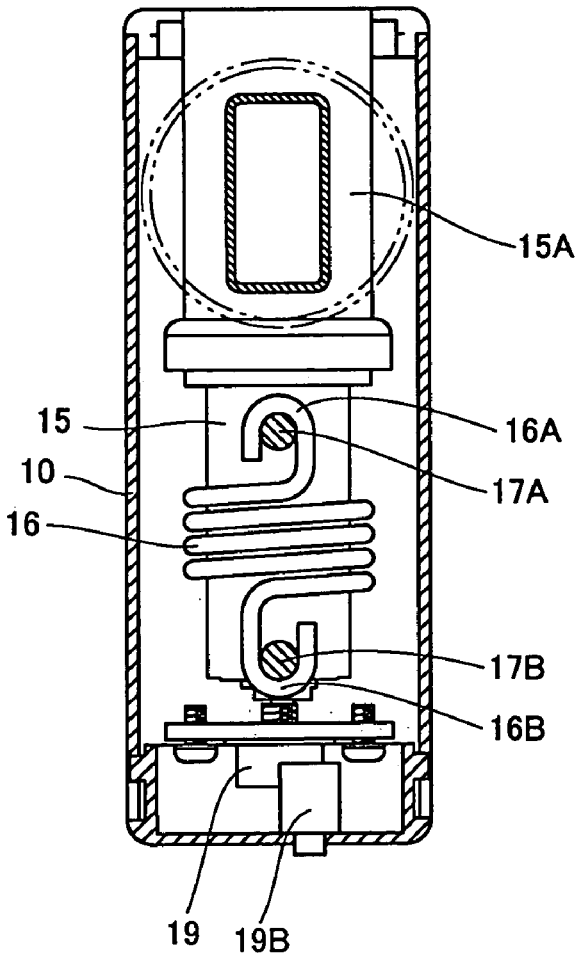
FIG. 5 is a partial cross-sectional view taken along V—V in FIG. 4.

FIG. 4 is an enlarged partial cross-sectional side-view around handlebar 9. FIG. 5 shows a partial cross section taken along V—V (only the inside of tubular member 10) in FIG. 4. It is noted that in FIG. 4 handlebar 9 is not shown.

Referring to FIGS. 4 and 5, shaft 15 that is inserted into a head tube 15A and serves as a rotary shaft rotating in connection with the rotating motion of handlebar 9 is provided inside tubular member 10.

The restoring mechanism for handlebar 9 as described above is configured with a coil spring 16 wound around the outer circumference of shaft 15, a hook 16A (a first securing portion) securing one end of coil spring 16 to shaft 15, and a hook 16B (a second securing portion) securing the other end of coil spring 16 to tubular member 10.

Hook 16A is engaged with a bolt 17A secured to shaft 15, and hook 16B is engaged with a bolt 17B secured to tubular member 10.

In the configuration described above, when handlebar 9 is rotated, the end portion of coil spring 16 on the hook 16 B side is fixed by tubular member 10 while the end portion on the hook 16A side is moved with the rotation of shaft 15. Accordingly, torque acts on coil spring 16, and a restoring force forcing handlebar 9 to return to the initial position acts on shaft 15 as the counteraction against the torque. In this way, the restoring mechanism as described above can be obtained. This configuration allows a counter-force (restoring force) to act on the handlebar in proportion to the turning angle of the handlebar, thereby resulting in a smooth handlebar operation during a game operation.

It is noted that the first and second securing portions are not limited to the structure such as hooks 16A and 16B and may be structured such that the both end portions of coil spring 16 are directly connected to shaft 15 and tubular member 10, respectively, by welding or the like.

Although the restoring mechanism may be structured, for example, such that tubular member 10 is connected to body 2 by an elastic member outside tubular member 10, the structure using the coil spring as described above allows the restoring mechanism to be accommodated inside tubular member 10, resulting in a compact structure. In addition, the tubular member can protect the coil spring, and the life of the apparatus can therefore be prolonged.

The handlebar rotation angle detector may include, for example, a variable resistor 19. Variable resistor 19 is secured to tubular member 10 with an attachment 18 and has a driving shaft 19A connected to shaft 15 with an upper spacer 20 interposed as a connecting member. With this configuration, a rotation amount of driving shaft 19A that rotates along with the rotation of handlebar 9 is measured by variable resistor 19, so that the rotation amount of handlebar 9 can be measured. The detected rotation amount is output as an electrical signal through an output terminal 19B.

Figure 6:
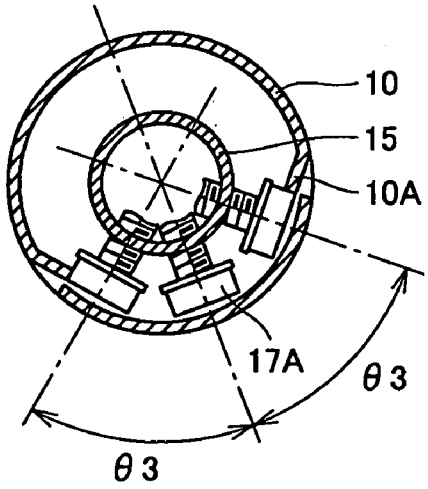
FIG. 6 is a cross-sectional view taken along VI—VI in FIG. 4.

FIG. 6 shows a cross section taken along VI—VI in FIG. 4.

Tubular member 10 includes a stopper portion 10A (a stopper mechanism) limiting the rotation angle of handlebar 9.

Stopper portion 10A is formed by cutting and denting a part of tubular member 10. This stopper portion 10A interferes with bolt 17A secured to shaft 15 to limit the rotation of shaft 15. In FIG. 6, for example, shaft 15 can rotate by an angle of θ 3 from the initial position to either side. Most preferably, θ 3 is approximately 50°.

The configuration described above allows a moderate handlebar operation during the operation of stationary bike 1.

In the following, a structure of a connection portion between shaft 15 and variable resistor 19 will be described in more detail with reference to FIGS. 7–11.

Figure 7:
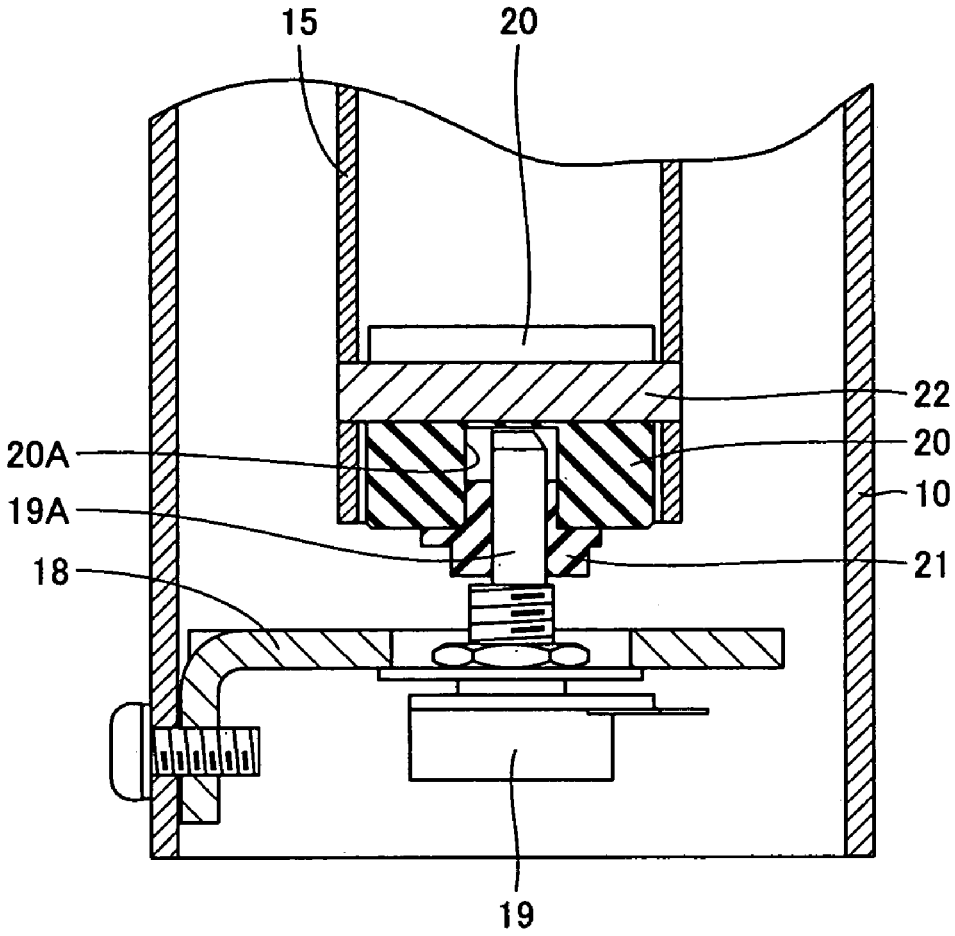
FIG. 7 is an enlarged cross-sectional side view showing a connection portion between a shaft and a variable resistor in the stationary bike in accordance with one aspect of the present invention.

FIG. 7 is an enlarged view showing the aforementioned connection portion. As shown in FIG. 7, shaft 15 has upper spacer 20 (a connecting member) and a pin 22, through which driving shaft 19A of variable resistor 19 is connected to shaft 15. With this configuration, driving shaft 19A is driven to rotate by shaft 15, and the handlebar rotation angle can be detected by variable resistor 19. A lower spacer 21 formed, for example, of an elastic member such as rubber is arranged-between upper spacer 20 and driving shaft 19A.

Figure 8:
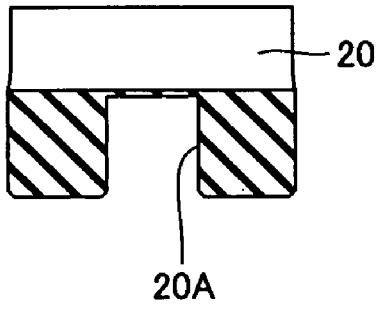
FIG. 8 is a cross-sectional side view showing an upper spacer shown in FIG. 7.
Figure 9:
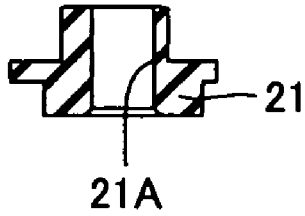
FIG. 9 is a cross-sectional side view showing a lower spacer shown in FIG. 7.
Figure 10:
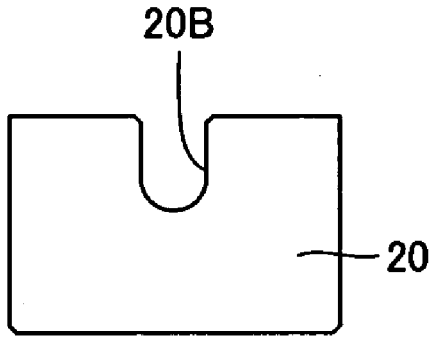
FIG. 10 is a front view of the upper spacer shown in FIG. 7.
Figure 11:
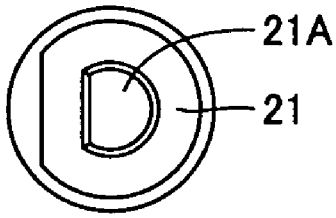
FIG. 11 is a top view of the lower spacer shown in FIG. 7.

FIGS. 8–11 are exploded views showing upper and lower spacers 20 and 21. FIGS. 8 and 9 show the cross-sectional side views of the upper and lower spacers 20 and 21, respectively, FIG. 10 shows a front view of upper spacer 20 as seen from the direction orthogonal to the direction of FIG. 8, and FIG. 11 is a top view of lower spacer 21.

As shown in FIGS. 7, 8 and 10, upper spacer 20 has a groove portion 20A (a first groove portion) receiving driving shaft 19A and a groove portion 20B (a second groove portion) receiving pin 22 in such a manner that it can be rotated (rolled). The first and second groove portions are provided in the directions orthogonal to each other.

As shown in FIGS. 7, 9 and 11, lower spacer 21 has an opening 21A through which driving shaft 19A is inserted. Lower spacer 21 with driving shaft 19A of variable resistor 19 being inserted is fitted into groove portion 20A of upper spacer 20.

Handlebar 9 rotates about the shaft center (the up/down direction in FIG. 7) of shaft 15 and driving shaft 19A. Here at the tip end of shaft 15 on the side of variable resistor 19, a certain amount of margin (play) is preferably provided with respect to the rotation about the axis in the forward/backward direction as well as the right/left direction in FIG. 7.

On the other hand, in the configuration described above, deflection caused by the rotation about the axis in the right/left direction in FIG. 7 can be absorbed by upper spacer 20 rotating about pin 22, and deflection caused by the rotation about the axis in the forward/backward direction in FIG. 7 can be absorbed by lower spacer 21 being elastically deformed.

As described above, in accordance with the present embodiment, the deflection at the tip end of shaft 15 on the variable resistor 19 side during the handlebar operation can be absorbed. As a result, an improper force is not exerted on driving shaft 19A of variable resistor 19, and the handlebar rotation angle can properly be detected, thereby improving the reliability of the detection result. Additionally, the life of the apparatus can be prolonged.

Although, in the present embodiment, in order to provide a virtual operation of a bicycle using a stationary bike, pedal 5 is used as an accelerator and brake button 11 is used as a brake, the accelerator and the brake are not limited thereto. Alternatively, the accelerator may employ a throttle system that virtually accelerates the bike by rotating a grip portion 9A of handlebar 9, and the brake may employ a brake lever structure attached to handlebar 9. In this case, stationary bike 1 can be used to perform a virtual operation of a motor cycle having a prime mover.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A stationary bike controlling a display content appearing on a screen, comprising:

a body;

a handlebar rotatably attached to said body;

control means for controlling said display content appearing on the screen;

a rotary shaft rotating in connection with a rotating motion of said handlebar;

a tubular member mounted on the body and accommodating said rotary shaft, and a restoring mechanism within said tubular member to restore said handlebar from a rotationally displaced position to an initial position; said restoring mechanism including a coil spring wound around an outer circumference of said rotary shaft, first securing means for securing one end of said coil spring to said rotary shaft, and second securing means for securing the other end of said coil spring to said tubular member.

2. The stationary bike according to claim 1, further comprising:

handlebar rotation angle detecting means for detecting a rotation angle of said handlebar;

a pedal connected to said body;

speed signal generating means for generating a speed signal in accordance with a rotation speed of said pedal; and brake signal generating means for generating a brake signal; wherein said control means includes a controller receiving a signal from said handlebar rotation angle detecting means, said speed signal generating means and said brake signal generating means for being reflected in said display content on the screen.

3. The stationary bike according to claim 1, wherein an angle between an installation plane where said body is installed on a horizontal plane and a shaft center of said rotary shaft is at least 68° and at most 73°.

4. The stationary bike according to claim 2, wherein said handlebar rotation angle detecting means has a driving shaft driven to rotate by said rotary shaft, said rotary shaft has a connecting member having a first groove portion receiving said driving shaft for connecting said rotary shaft to said driving shaft and a pin attached to said rotary shaft and extending in a direction orthogonal to said first groove portion, said connecting member includes a second groove portion receiving said pin in a rotatable manner, and a spacer formed of an elastic member is arranged between said connecting member and said driving shaft.

5. The stationary bike according to claim 1, comprising a stopper mechanism for limiting a rotation angle of said handlebar.

6. A stationary bike controlling a display content appearing on a screen, comprising:

a body;

a handlebar rotatably attached to said body;

a rotary shaft rotating in connection with a rotating motion of said handlebar;

a tubular member mounted to the body and accommodating said rotary shaft;

a restoring mechanism within said tubular member to return said handlebar from a rotatably displaced position to an initial position, said restoring mechanism including a coil spring wound around an outer circumference of said rotary shaft, one end of said coil spring being secured to said rotary shaft, and the other end of said coil spring being secured to said tubular member;

a handlebar rotation angle detector operably connected to said rotary shaft, the detector having a driving shaft driven to rotate by said rotary shaft, said rotary shaft including a connecting member having a first groove portion receiving said driving shaft for connecting said rotary shaft to said driving shaft and a pin attached to said rotary shaft and extending in a direction orthogonal to said first groove portion, said connecting member including a second groove portion receiving said pin in a rotatable manner, and having a spacer formed of an elastic member arranged between said connecting member and said driving shaft;

a pedal connected to said body;

a speed signal generator operably connected to said pedal and responsive to a rotation speed of said pedal;

a brake signal generator mounted on said handlebar constructed and arranged for generating a brake signal;

a controller operably connected to and receiving a signal from said handlebar rotation angle detector, said speed signal generator and said brake signal generator, said signal being reflected in said display content on the screen.

* * * * *